US007914139B2

(12) United States Patent
Kawaguchi et al.

(10) Patent No.: US 7,914,139 B2
(45) Date of Patent: Mar. 29, 2011

(54) CLOTH HOLDING FRAME

(75) Inventors: Yasuhiko Kawaguchi, Nagoya (JP); Motoshi Kishi, Nagoya (JP); Haruna Kato, Tsushima (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 449 days.

(21) Appl. No.: 11/448,753

(22) Filed: Jun. 8, 2006

(65) Prior Publication Data

US 2006/0290763 A1 Dec. 28, 2006

(30) Foreign Application Priority Data

Jun. 23, 2005 (JP) ..... 2005-183541

(51) Int. Cl.
*B41J 29/12* (2006.01)

(52) U.S. Cl. ..... 347/101; 347/2; 347/35; 347/104

(58) Field of Classification Search ..... 347/104, 347/101, 2, 35
See application file for complete search history.

(56) References Cited

U.S. PATENT DOCUMENTS

| | | | | |
|---|---|---|---|---|
| 5,113,206 | A * | 5/1992 | Fukazawa | 347/86 |
| 6,401,641 | B1 * | 6/2002 | Miyano | 112/470.05 |
| 6,860,583 | B2 | 3/2005 | Cheney et al. | |
| 6,908,190 | B2 | 6/2005 | Iwatsuki et al. | |
| 2003/0197772 | A1 * | 10/2003 | Iwatsuki et al. | 347/104 |
| 2004/0125154 | A1 * | 7/2004 | Cheney et al. | 346/35 |
| 2004/0189776 | A1 * | 9/2004 | Niimi et al. | 347/104 |
| 2004/0221780 | A1 * | 11/2004 | Kawaguchi et al. | 112/102.5 |

FOREIGN PATENT DOCUMENTS

| | | |
|---|---|---|
| JP | A-2-526 | 1/1990 |
| JP | A 5-84887 | 4/1993 |
| JP | A-5-272046 | 10/1993 |
| JP | 09279469 A * | 10/1997 |
| JP | A-2000-198224 | 7/2000 |
| JP | A 2002-234188 | 8/2002 |
| JP | A-2003-118139 | 4/2003 |
| JP | A-2003-246053 | 9/2003 |
| JP | A-2003-312069 | 11/2003 |
| JP | A-2004-121966 | 4/2004 |
| JP | A-2004-141758 | 5/2004 |
| JP | A-2004-209980 | 7/2004 |

OTHER PUBLICATIONS

Foreign Office Action mailed Dec. 8, 2010 in Japanese Application No. 2005-183541 (with translation).
Partial Translation of JP-A-2003-246053.
Partial Translation of JP-A-2000-198224.

* cited by examiner

*Primary Examiner* — Laura E Martin
(74) *Attorney, Agent, or Firm* — Oliff & Berridge, PLC

(57) ABSTRACT

A cloth holding frame is removably set on a frame driving mechanism in a printer including a print head. The cloth holding frame holding the cloth to be printed is detachably provided with the ink tray to receive a jet of ink from the print head by a flushing, and is moved to a flushing position based on a moving distance and, in association therewith, a type of the cloth holding frame set in the printer. Accordingly, the maintenance time for the flushing becomes shorter. The speed of the printing process is enhanced. The controlling operation of the frame driving mechanism to perform the flushing becomes simplified, and the printer can be downsized.

12 Claims, 20 Drawing Sheets

FIG. 13

(CLOTH HOLDING FRAME TYPE TABLE)

| TYPE OF CLOTH HOLDIGNG FRAME | FIRST DETECTION SWITCH SIGNAL | SECOND DETECTION SWITCH SIGNAL | THIRD DETECTION SWITCH SIGNAL |
|---|---|---|---|
| CLOTH HOLDING FRAME A | L | L | L |
| CLOTH HOLDING FRAME B | H | L | L |
| CLOTH HOLDING FRAME C | L | H | L |
| CLOTH HOLDING FRAME D | L | L | H |
| CLOTH HOLDING FRAME E | H | H | L |
| CLOTH HOLDING FRAME F | H | L | H |
| CLOTH HOLDING FRAME G | L | H | H |
| CLOTH HOLDING FRAME H | H | H | H |

FIG. 14

(FRAME INFORMATION TABLE)

| TYPE OF CLOTH HOLDIGNG FRAME | PRINTING AREA | ORIGIN POINT | DISTANCE TO INK TRAY WITH RESPECT TO ORIGIN POINT |
|---|---|---|---|
| CLOTH HOLDING FRAME A | a1~a4 | Oa | Ya |
| CLOTH HOLDING FRAME B | b1~b4 | Ob | Yb |
| CLOTH HOLDING FRAME C | c1~c4 | Oc | Yc |
| CLOTH HOLDING FRAME D | d1~d4 | Od | Yd |
| CLOTH HOLDING FRAME E | e1~e4 | Oe | Ye |
| CLOTH HOLDING FRAME F | f1~f4 | Of | Yf |
| CLOTH HOLDING FRAME G | g1~g4 | Og | Yg |
| CLOTH HOLDING FRAME H | h1~h4 | Oh | Yh |

CLOTH HOLDING FRAME

TECHNICAL FIELD

The disclosure relates to a cloth holding frame and a printer, especially to the cloth holding frame for holding a cloth to be printed, and a printer for printing on the cloth held by the cloth holding frame with an inkjet head.

BACKGROUND

Conventionally, an inkjet printer comprises a color inkjet head having a plurality of inkjet nozzles, reciprocating the inkjet head in a parallel direction to a printing direction to provide inkjet color printing on various sizes of papers.

For instance, Japanese patent application laid-open No. 2002-234188 (Patent Document 1) discloses an inkjet printer having a carriage installed with an inkjet head and capable of moving the carriage from side to side to form various images on recording papers fed by a feeding roller with ink discharged in a downward jet from the inkjet head.

The inkjet printer disclosed in the Patent Document 1 comprises an ink tray for receiving the ink discharged from the head for a flushing, in a right end of a platen facing to the head. Therefore, at the flushing in starting printing and during printing, the head is moved to a maintenance position for performing the flushing when needed.

Furthermore, variety of techniques for printing patterns and designs on various clothes has been suggested. An inkjet printer capable of printing the patterns and the designs on surfaces of the clothes with the color ink directed in a jet from the ink nozzle to the clothes based on print data has been suggested.

For instance, Japanese patent application laid-open No. H05(1993)-84887 (Patent Document 2) discloses a printer in which a Y movable bar in such a manner that it can move in Y direction along a groove formed on both side faces of a machine frame of U-shape in top view. An X movable arm is supported to be movable along the Y movable bar, and an ink head is fixed on an end of the X movable bar. A holding frame holding a cloth for printing is fixedly mounted on a table provided in a center of the machine frame. In this case, the ink head performs printing on a fixed cloth while moving in X and Y directions.

In the inkjet printer disclosed in the Patent Document 1, however, the ink tray for the flushing is positioned outside the printable area, and in a flushing position specifically for the flushing positioned opposite to a right end of the platen. Therefore, there are problems that a length of the printer in a printing direction becomes longer, resulting in a large printer.

As well as in the printer disclosed in the Patent Document 2, the ink tray for the flushing is provided on the outside of the holding frame so that the cloth held by the holding frame become dirty. Therefore, there are problems that the moving distance of the ink head is longer, and the printer is larger.

SUMMARY

The disclosure has an object to overcome the above problems and to provide a cloth holding frame and a printer in which the cloth holding frame is set, which can reduce maintenance time for a flushing, enhance speed of printing process, simplify controlling operation of a driving mechanism for the flushing, and achieve downsizing of the printer.

To achieve the purpose of the disclosure, there is provided a cloth holding frame to be detachably set in a frame driving mechanism of an inkjet printer having an inkjet head and the frame driving mechanism adapted to move the cloth holding frame, the cloth holding frame being configured to hold a cloth to be printed and comprising: one of an integrally-formed ink tray and a detachable ink tray, for receiving an ink discharged from the inkjet head in flushing the inkjet head.

In the cloth holding frame having the above structure, the ink tray is detachably or integrally provided in the cloth holding frame to receive the jet discharged in the jet from the inkjet head by the flushing. Accordingly, the cloth holding frame is moved to the position in which the ink tray provided in the cloth holding frame faces the inkjet head, and then the flushing is performed. Therefore, the ink discharged in the jet from the inkjet head by the flushing is never spilled out, and is surely received by the ink tray without being missed.

Furthermore, the ink tray is provided in the cloth holding frame, so that the flushing can be performed while the cloth holding frame is moved horizontally, without the vertical movement of the inkjet head. Accordingly, the maintenance time for the flushing becomes shorter, and the speed of the printing process is enhanced. Further, the controlling operation of the frame driving mechanism to perform the flushing becomes simplified, and the printer can be downsized.

Especially in the case where the ink tray is detachably provided in the cloth holding frame, the ink tray can be removed from the cloth holding frame while the cloth is set in or removed. This can avoid the ink tray from being the obstacle while the setting/removing operation. Also, this can avoid the cloth and fingers of the operator form getting dirty while the setting/removing operation.

According to another aspect of the disclosure, there is provided a printer comprising: a cloth holding frame; a frame driving mechanism for moving the cloth holding frame in each of two directions intersecting at right angles with respect to the inkjet head, and for performing printing on a cloth while moving the cloth holding frame with respect to the inkjet head, and one of an integrally-formed ink tray and a detachable ink tray, for receiving an ink discharged from the inkjet head in flushing for the inkjet head.

In the printer having the above structure, the ink tray is detachably or integrally provided in the cloth holding frame to receive the ink directed in the jet from the inkjet head by the flushing. Accordingly, the cloth holding frame is moved to the position in which the ink tray provided in the cloth holding frame faces the inkjet head, and then the flushing is performed. Therefore, the ink discharged in the jet from the inkjet head by the flushing is never spilled out, and is surely received by the ink tray without being missed.

BRIEF DESCRIPTION OF THE DRAWINGS

FIG. 13 is a cloth holding frame type table;

FIG. 14 is a frame information table;

DETAILED DESCRIPTION

Figure 1:
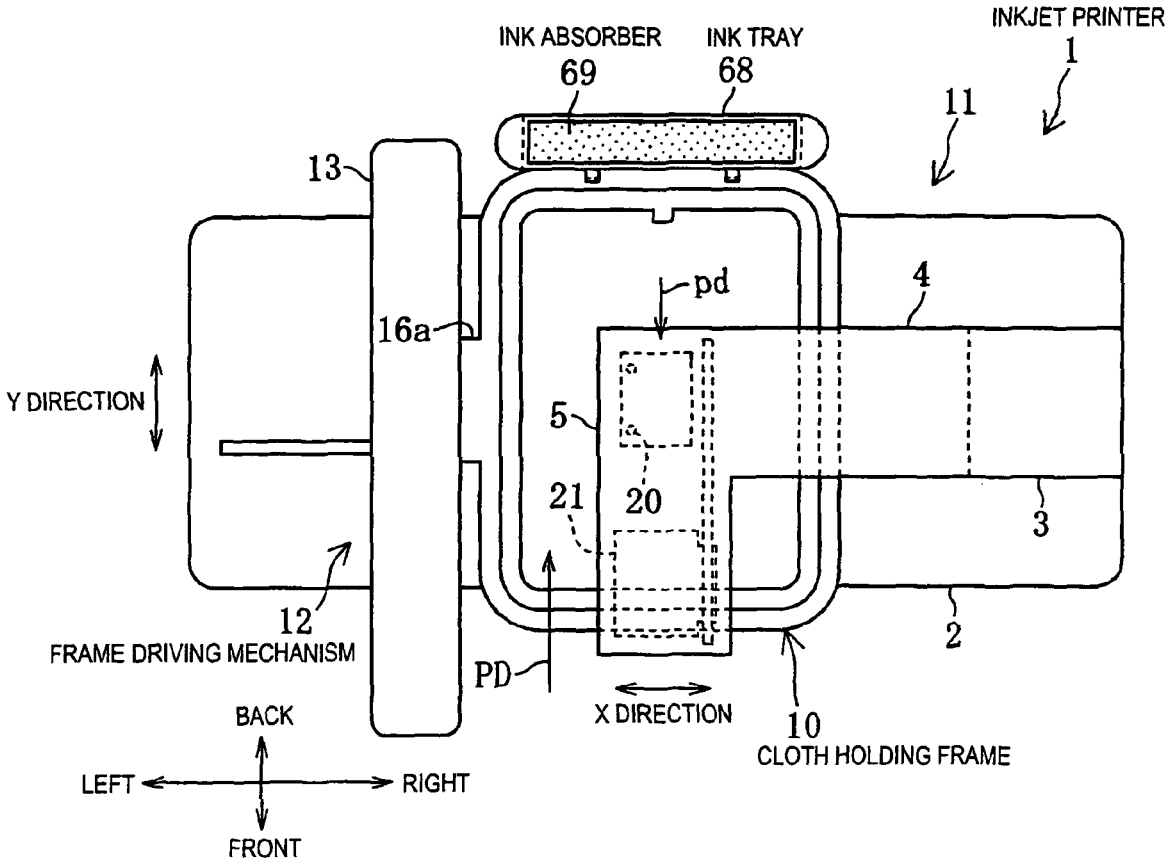
FIG. 1 is a plan view of a printer in an aspect of the disclosure.

A detailed description of at least one of some example aspects of a cloth holding frame and a printer embodying the disclosure will now be given referring to the accompanying drawings.

A cloth holding frame and a printer of the disclosure comprise an ink tray which is removably provided outside a rim of an outer frame of the cloth holding frame. Also, the cloth holding frame and the printer are configured to perform printing on a cloth with an inkjet head incorporated into a print unit while the cloth holding frame is moving in each of two directions intersecting at right angles, and to arrange for an ink tray to receive a jet of ink from the inkjet head by a flushing.

Firstly, a structure of an inkjet printer 1 capable of printing desired pattern and design on cloth W held by a cloth holding frame 10 including an inner frame 15 and an outer frame 16, with an inkjet head 36 provided in a print unit 30 using color ink will be explained.

Figure 2:
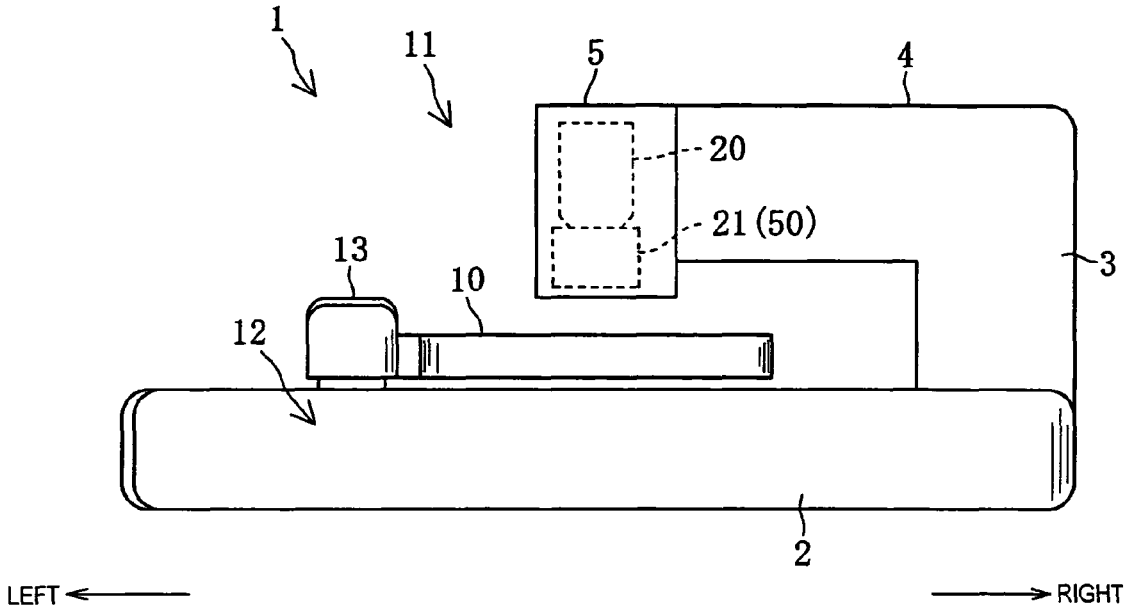
FIG. 2 is a front view of the printer in the aspect of the disclosure.

As shown in FIGS. 1 and 2, the printer 1 comprises the cloth holding frame 10 which holds the cloth W detachably, a printer main body 11 which includes a print mechanism 20 having the inkjet head 36 (hereinafter, referred to as a "print head") for printing on the cloth W held by the cloth holding frame 10, and a maintenance mechanism 21 capable of performing maintenance of the print head 36 of the print mechanism 20, and a frame driving mechanism 12 which moves the cloth holding frame 10 in each of the X direction and the Y direction orthogonal thereto so that a printing position of the print head 36 on the cloth W in each of the two directions (the X and Y directions) intersecting at right angles.

Figure 3:
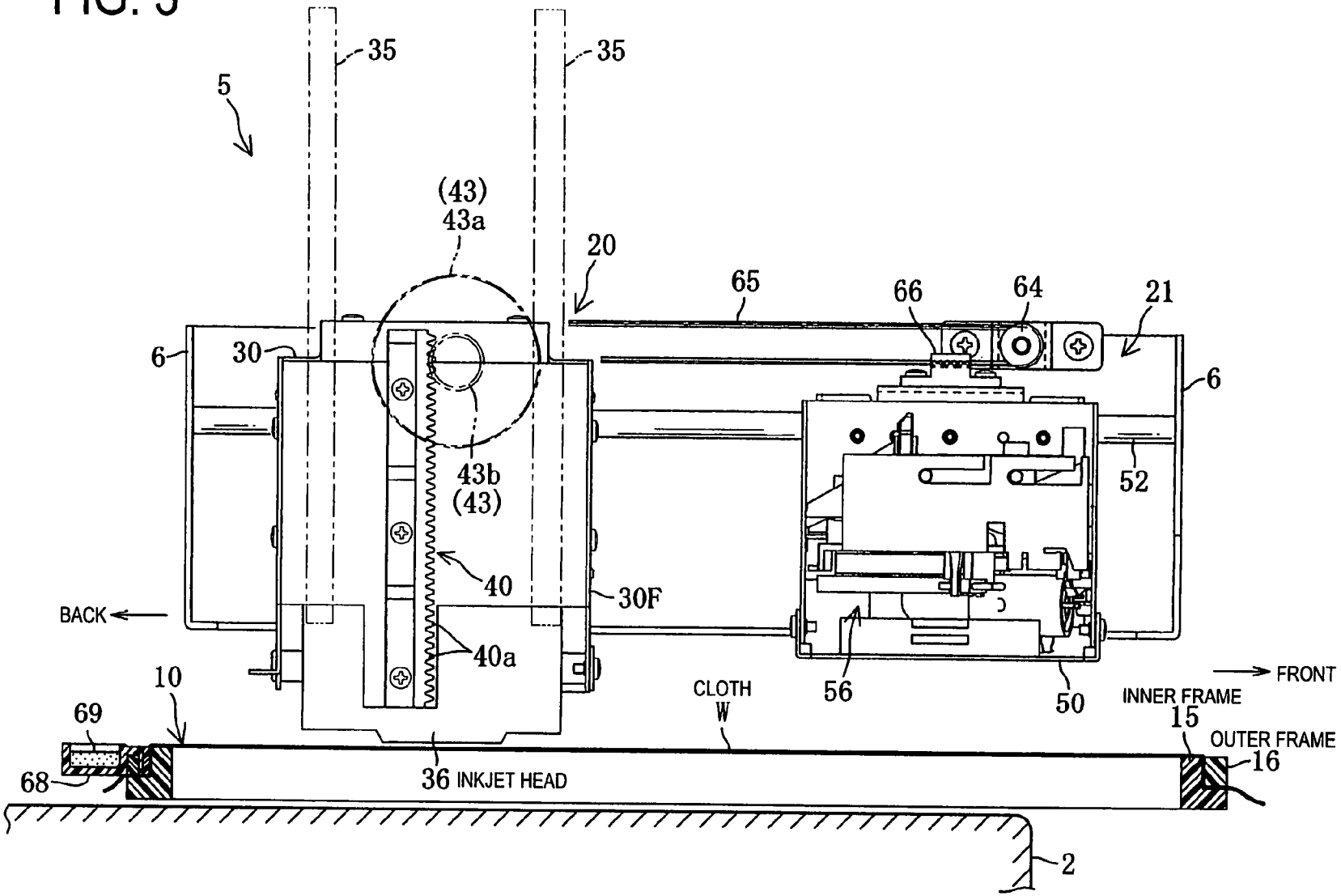
FIG. 3 is a left side view of a printer main body.
Figure 6:
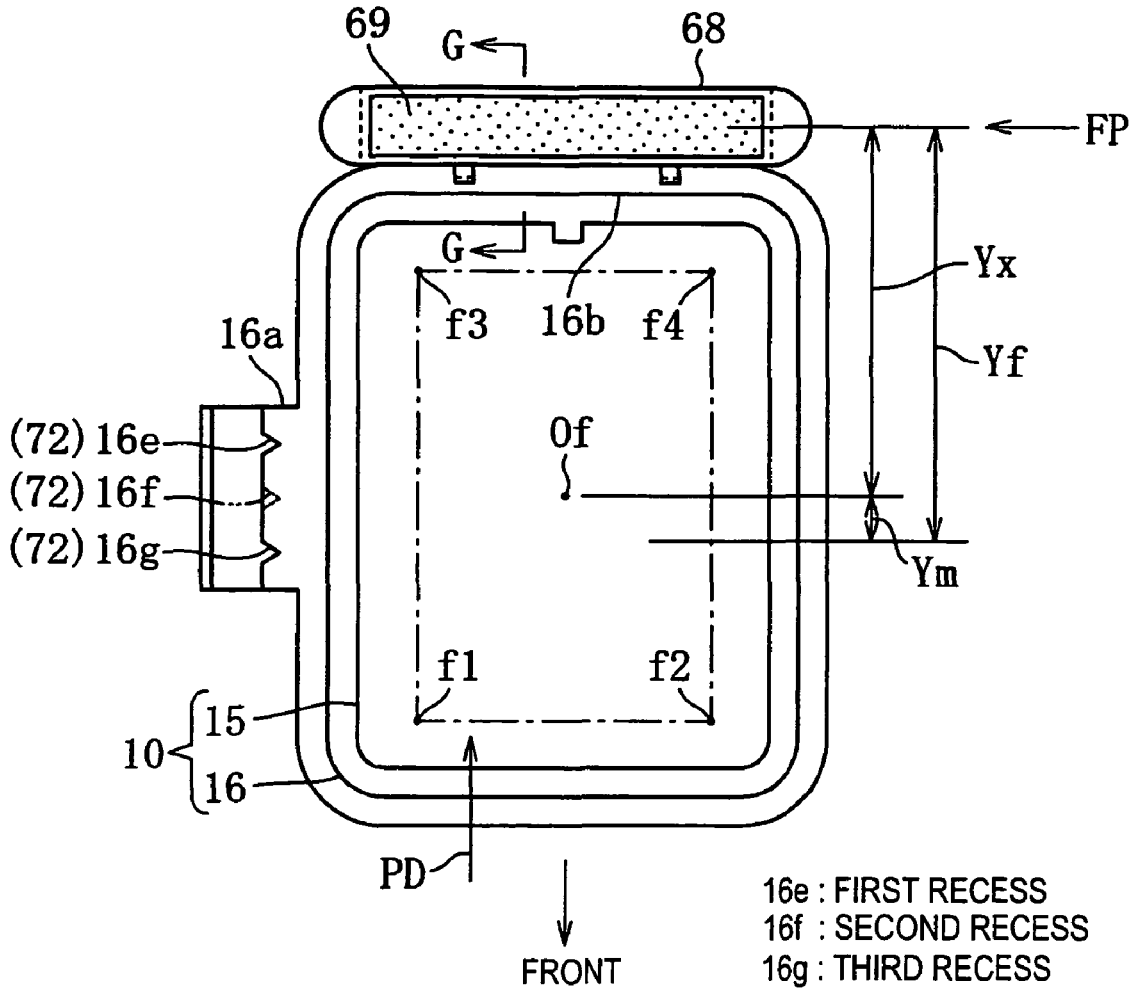
FIG. 6 is a plan view of a cloth holding frame.
Figure 7:
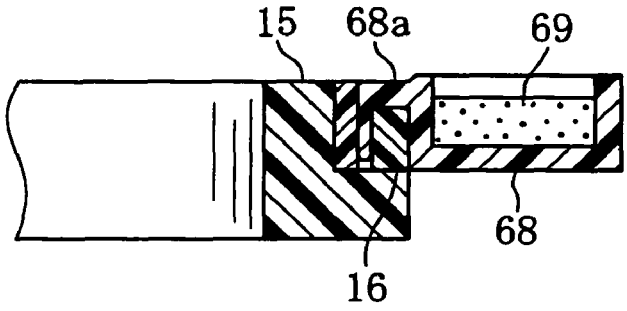
FIG. 7 is a longitudinal sectional view of FIG. 6 in a line G-G.

The cloth holding frame 10 comprises the inner frame 15 and the outer frame 16 made of synthetic resin, as shown in FIGS. 1, 3 and 6. In printing, as shown in FIG. 3, the cloth W to be printed is held tightly between the inner frame 15 and the outer frame 16. It is noted that the cloth W is set in the cloth holding frame 10 with an adhesive supporting sheet (not shown) previously stuck to the back (the underside) thereof so that the cloth W is set without creases.

A connecting part 16*a* is integrally formed with the outer frame 16, and removably fit into a Y carriage 13 of the frame driving mechanism 12. Noted that the cloth holding frame 10 is shaped like a rectangle, but the various shapes of frames such as an ellipse and a circle may be applicable.

As shown in FIGS. 1 and 2, the printer main body 11 comprises a bed 2 of which long side is positioned in a lateral direction, a column 3 standing uprightly at the right end of the bed 2, and an arm 4 extending to the left from the column 3. The frame driving mechanism 12 is installed inside the bed 2. An end of the arm 4 is perpendicularly bent toward the front substantially like an L shape in top view. A mechanism attachment 5 is provided in the end of the arm 4. The print mechanism 20 and the maintenance mechanism 21 are attached to the mechanism attachment 5.

The print mechanism 20 is positioned in the rearward part of the mechanism attachment 5, being able to move up and down. The maintenance mechanism 21 is arranged to be movable back and forth between a standby position on a front side and a maintenance position on the rear side under the print mechanism. In FIG. 1, an arrow PD pointing in the rearward direction indicates a moving direction (a printing direction) of the cloth holding frame 10 holding the cloth W in printing. An arrow pd pointing in the forward direction indicates a printing direction for the print mechanism 20.

More specifically, the cloth holding frame 10 can move back and forth (the Y direction), and from side to side (the X direction) being driven by the frame driving mechanism. Printing is performed with the print head 36 only when the cloth holding frame 10 moves backward in the printing direction PD. This printing is so-called one-way printing. Therefore, the printing direction with respect to the cloth W is the direction of the arrow pd.

After printing has completed in one row, the cloth holding frame 10 is moved toward the front side (the opposite direction in the printing direction PD), and then toward the left and the right (the X direction). After that, printing is performed in a next row while the cloth holding frame 10 is moved along the printing direction PD. In this manner, printing can be performed over the whole printable area within the cloth holding frame 10 on the cloth W while the cloth holding frame 10 is moved repeatedly along the printing direction PD.

On a front face of the column 3, there are provided a display for selecting the pattern and the design to be printed and a showing of various kinds of setting screens, variety of switches, and display lamps for showing the set conditions. Also on the front face of the column 3, a jack connectable to electronic equipment such as a personal computer through a USB cable, and a connector attachable to a memory card such as a ROM card and a RAM card. All the above items are not shown in the figures.

Figure 12:
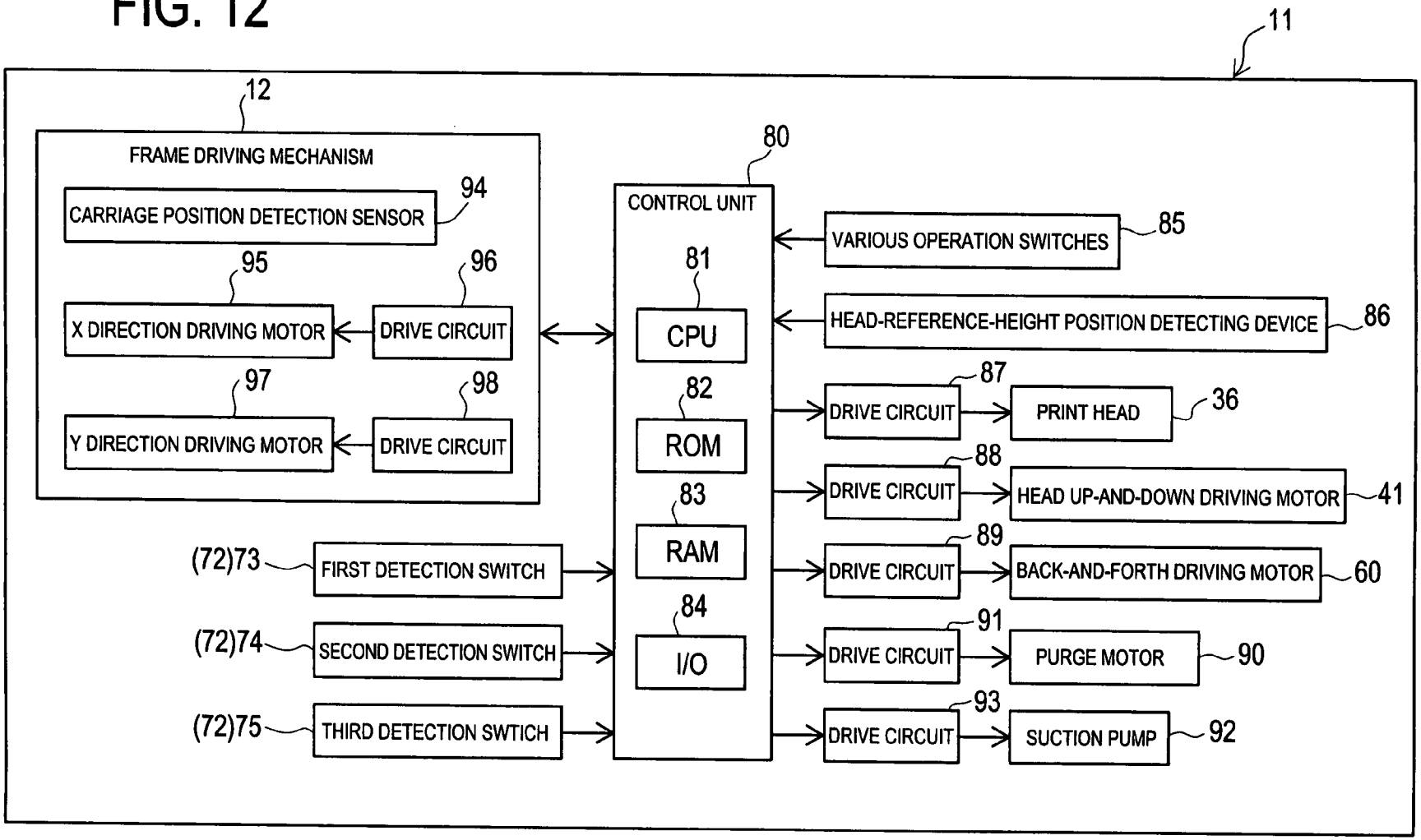
FIG. 12 is a block diagram of a control system of the printer.

The frame driving mechanism 12 (not shown) comprises a Y direction driver which moves the cloth holding frame 10 set in the Y carriage 13 provided on the bed 2 in the Y direction (the back-and-forth direction) with a Y direction driving motor 97 (see FIG. 12). The frame driving mechanism 12 (not shown) also comprises an X direction driver which is installed inside the bed 2 and moves the Y carriage 13 in the X direction (the side-to-side direction) with an X direction driving motor 95 (see FIG. 12).

Next, the print mechanism 20 provided in the mechanism attachment 5 will be explained with reference to FIGS. 3 to 5. A chassis 6 formed like a substantially rectangular frame is provided in the mechanism attachment 5. The print mechanism 20 is installed inside the chassis 6 on the rear side. The print mechanism 20 has a print unit 30 including the print head 36, an up-and-down driving mechanism 31 which moves the print unit 30 up and down so that it comes close to or away from the cloth W.

Firstly, the print unit 30 of a box shape will be explained. A pair of head guide shafts 35 is uprightly placed in a rear left side of the chassis 6 aligned in the back-and-forth direction, and both top and low ends of the head guide shafts 35 are supported by the chassis 6. A unit frame 30F which is one components of the print unit 30 is supported on the left side by the pair of the head guide shafts 35, being movable up and down. It is noted that the print unit 30 is arranged as an inkjet system.

Therefore, the print head 36 is provided in a bottom of the print unit 30, facing downward. Four types of ink cartridges (not shown) containing four different color inks (cyan, magenta, yellow and black) respectively, and ink feeding pipes (not shown) connecting the ink cartridges to the print head 36, both of which are not shown, are installed in upper part of the print head 36.

Figure 4:
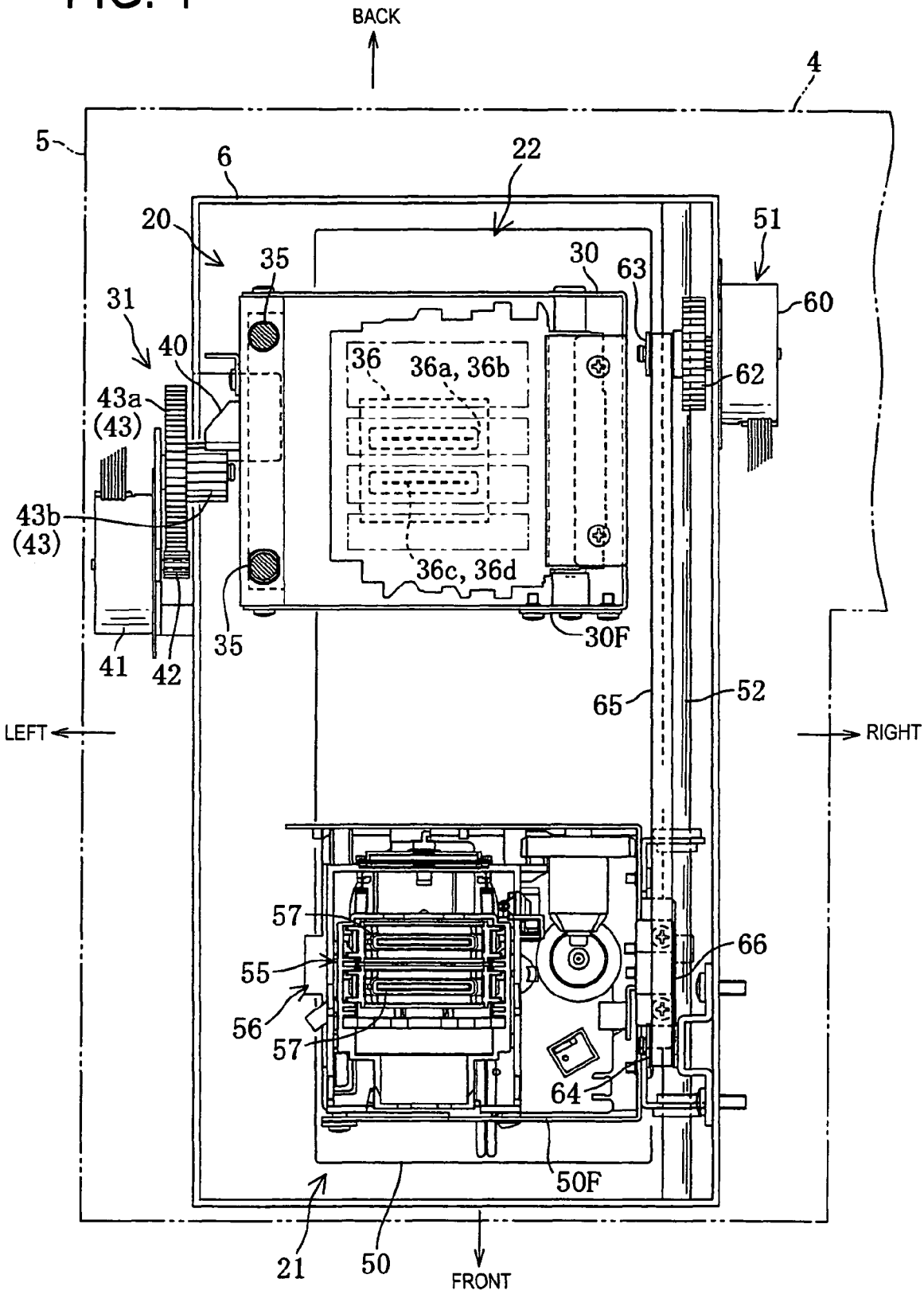
FIG. 4 is a plan view of the printer main body.
Figure 5:
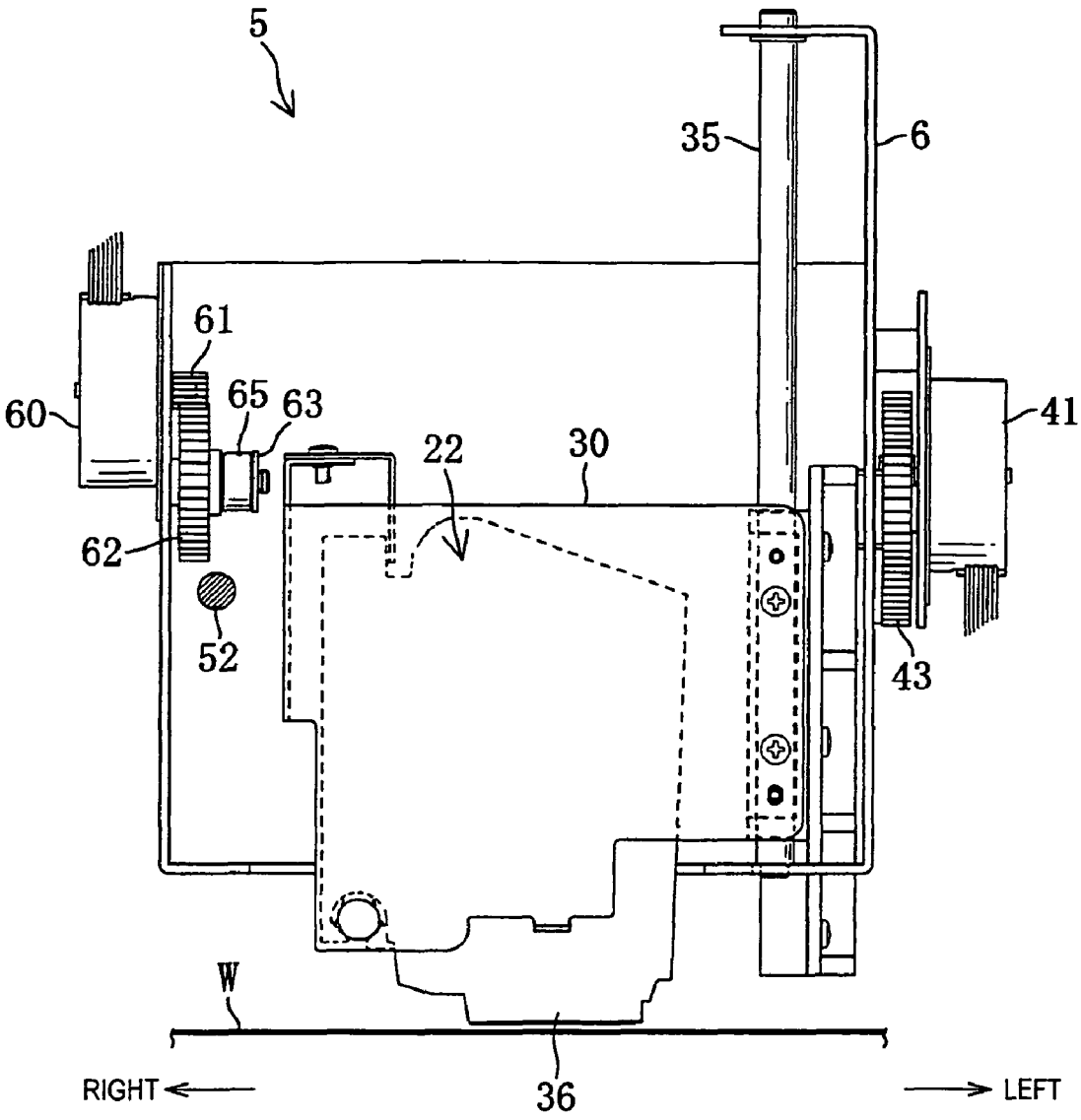
FIG. 5 is a back view of the printer main body.

As shown in FIG. 4, the print head 36 includes four nozzle lines 36*a* to 36*d* unitized into two rows by two nozzle lines (36*a* and 36*b*, and 36*c* and 36*d*) closely placed to each other. Each of the nozzle lines 36*a* to 36*d* has a plurality of jet nozzles in one line. The print head 36 can print each line in one-inch width. When receiving a print command from a control unit 80 described later, the print head 36 directs a jet of the inks supplied from the ink cartridges downward at the cloth W from the nozzle lines 36*a* to 36*d* by a deformation of a piezoelectric ceramic actuator.

Next, the up-and-down driving mechanism 31 which moves the print unit 30 up and down will be explained. As shown in FIGS. 3 to 5, a rack member 40 is vertically fixed to an outer left side of the unit frame 30F with a plurality of screws. A head up-and-down driving motor 41 is attached to a part of the chassis 6 facing the left side of the unit frame 30F. Further, a gear complex 43 including a large diameter gear 43*a* which engages with a driving gear 42 supported by a driving axis of the head up-and-down driving motor 41 is also rotatably supported by the part of the chassis 6 facing the left side of the unit frame 30F. A small diameter gear 43*b* of the gear complex 43 is engaged with teeth 40*a* of the rack member 40 of the print unit 30.

Figure 10:
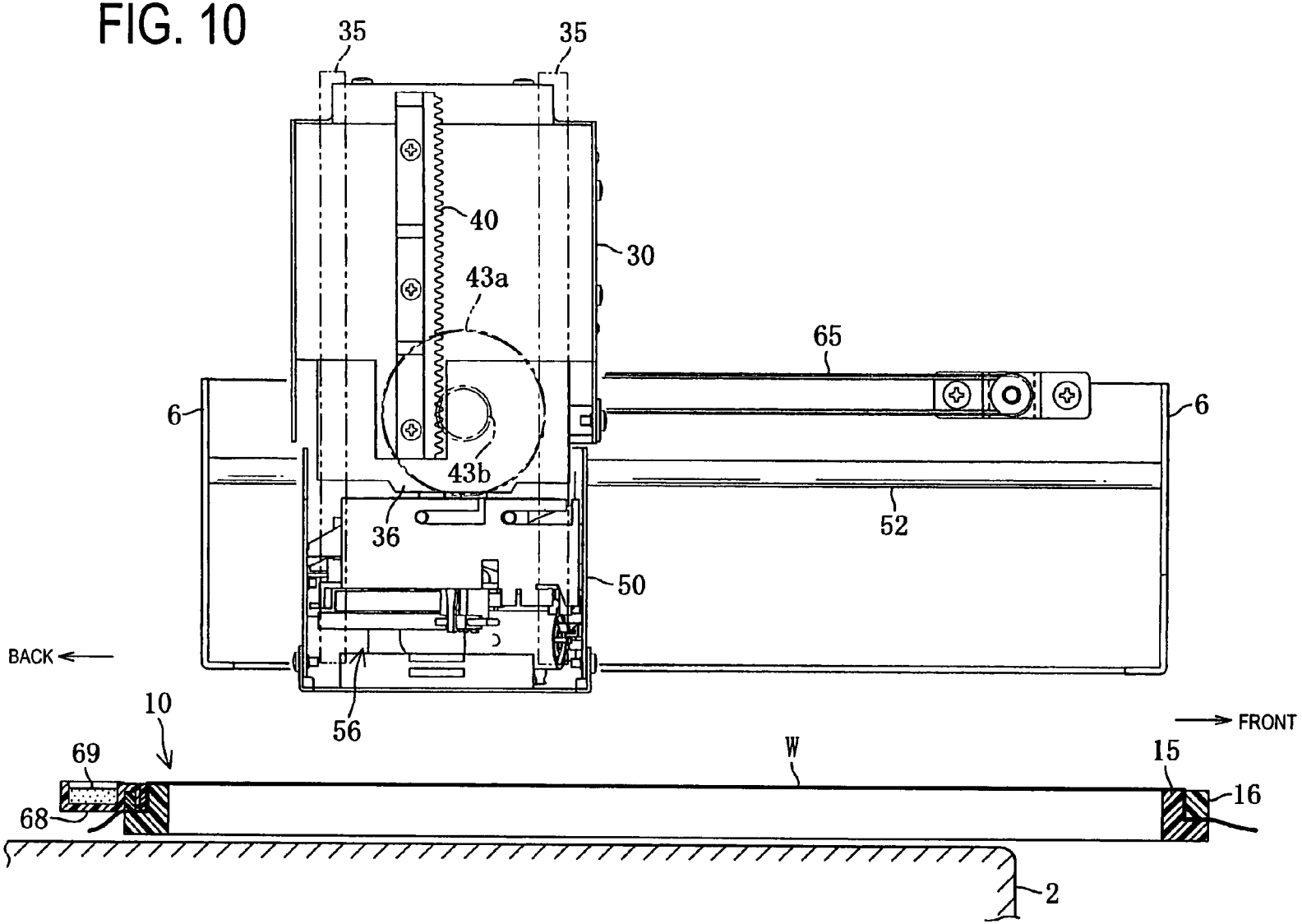
FIG. 10 is a left side view of the printer main body in a purging process, corresponding to FIG. 3.

Accordingly, while the head up-and-down driving motor 41 drives and rotates clockwise or counterclockwise, the print unit 30 moves up and down between an upper printing position shown in FIG. 3 and a lower printing position shown in FIG. 10 by an engagement of the gear complex 43 and the rack member 40, being guided by the pair of the head guide shafts 35.

Next, the maintenance mechanism 21 performing a purge except in printing will be explained. As shown in FIGS. 3 to 5, the maintenance mechanism 21 is movable between back and forth in the chassis 6, and comprises a maintenance unit 50 including a capping mechanism 55 and a purging mechanism 56, and a back-and-forth driving mechanism 51 to move the maintenance unit 50 back and forth.

Figure 11:
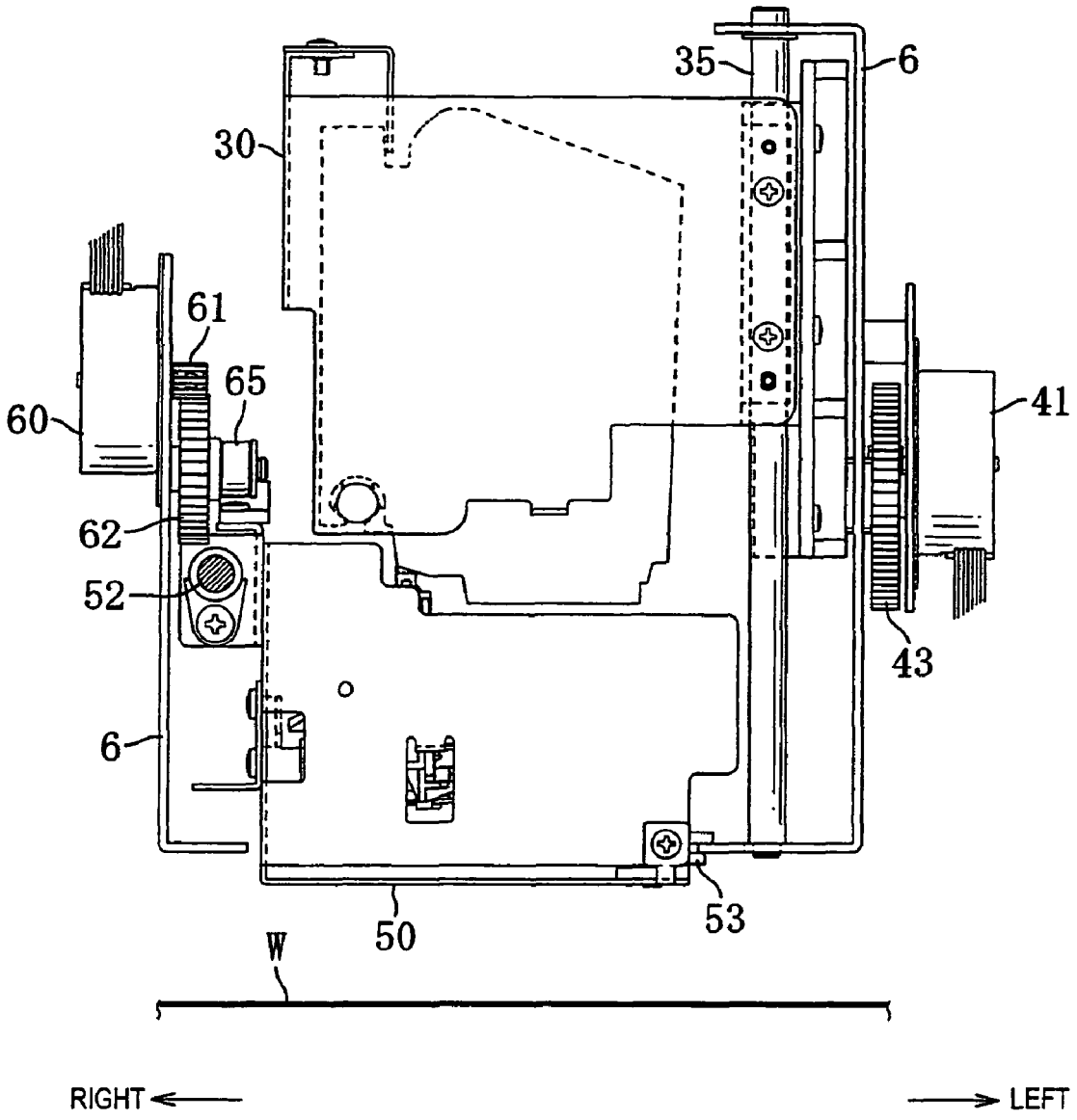
FIG. 11 is a back view of the printer main body in the purging process, corresponding to FIG. 5.

Firstly, the maintenance unit 50 shaped like the box will be explained. A maintenance guide shaft 52 is provided along the back-and-forth direction, and both back and front ends of the maintenance guide shaft 52 are supported by the chassis 6. A unit frame 50F which is one components of the print unit 30 is supported on the right side by the maintenance guide shaft 50, being movable back and forth. Also, as shown in FIG. 11, the unit frame 50F is supported being movable back and forth with the back-and-forth driving mechanism 51 described later, by an engagement member 53 fixed to the maintenance unit 50 being engaged with a bottom of the chassis 6.

The maintenance unit 50 has the capping mechanism 55 and the purging mechanism 56 which enable capping process and purging process respectively. An ink tray 68 to receive the jet of ink from the print head 36 by the flushing is removably provided outside the rim of the outer frame of the cloth holding frame 10, as described later.

Firstly, capping mechanism 55 will be briefly explained. The capping mechanism 55 comprises a pair of head caps 57 in the vicinity of the top part of the unit frame 50F. The capping mechanism 55 consists of rubber cap capable of being in a close contact with a surface of the print head 36 from below. A purge motor 90 (see FIG. 12) of the purge mechanism 56, described later, drives to move the head caps 57 upward, and bring it into contact with the surface of the print head 36 to cap the surface from below. This can prevent a plurality of the ink nozzles from being dried.

The purge mechanism 56 will be briefly explained. The purge mechanism 56 comprises a pair of the head caps 57 and a suction pump 92 (see FIG. 12). As aforementioned, when the head caps 57 are moved up to a position for capping, the purge mechanism 56 drives the suction pump 92 to cause a negative pressure inside the head cap 57 in capping state, and to suck bubbles which cause a blockage of the nozzles and the ink which becomes dried and highly viscous, maintaining a good printing state.

Next, the back-and-forth driving mechanism 51 will be explained. As shown in FIGS. 3 to 5, a back-and-forth driving motor 60 is secured to an outer wall of the chassis 6 in a right rear end thereof. A driving gear 61 is supported by the driving axis of the back-and-forth driving motor 60. A large-diameter driven gear 62 which engages with the driving gear 61 is rotatably supported by the chassis 6. Further, the driven gear 62 is integrally formed with a driving pulley 63. A driven pulley 64 is rotatably supported by the chassis 6 in the right front side, and a driving belt 65 of a timing belt is looped over the driving pulley 63 and the driven pulley 64.

The unit frame 50F which constitutes the print unit 30 is partially secured to the driving belt 65 with a fixing fitting 66. Therefore, the maintenance unit 50 can be moved from the standby position on the front side shown in FIGS. 3 and 4 to the maintenance position on the rear side shown in FIG. 10 with the driving gear 61, the driving pulley 63 and the driving belt 65, as the back-and-forth driving motor 60 is driven.

Next, the ink tray 68 provided outside the rim of the outer frame 16 of the cloth holding frame 10 will be explained.

As shown in FIG. 6, the ink tray 68 is provided in a short side 16*b* at the rear of the outer frame 16, or the outside (the rim side) of the short side 16*b* on the rear side opposite to an operator side (front side), when the cloth holding frame 10 is set in the Y carriage 13 as shown in FIG. 1.

The ink tray 68 is of a rectangular shape having a long side parallel with the nozzle lines 36*a* to 36*d*, and is longer than the nozzle lines 36*a* to 36*d*. An ink absorber 69 such as a sponge absorbable of the flushed ink by the print head 36 is provided at a center of the ink tray 68.

Figure 8:
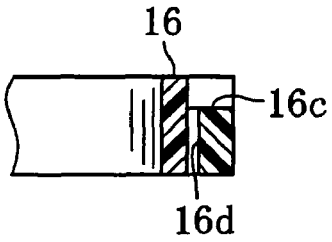
FIG. 8 is a longitudinal cross sectional view of a substantial part of an outer frame.
Figure 9:
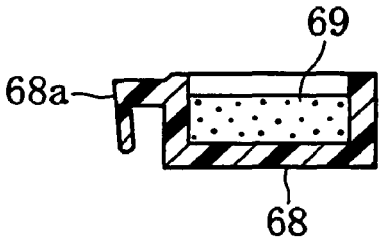
FIG. 9 is a longitudinal cross sectional view of an ink tray.

As shown in FIG. 9, a pair of hooks 68*a* is integrally provided on either side of the ink tray 68. In an upper end of the outer frame 16 as shown in FIG. 8, hollows 16*c* are provided facing to the hooks 68*a*, and slits 16*d* are vertically formed connecting to the hollows 16*c*. The ink tray 68 can be detachably set outside the rim of the outer frame 16 with the hooks 68*a* to be engaged with the hollows 16*c* and the slots 16*d* on the opposite side in the outer frame.

Next, a frame-type detection mechanism 72 to detect the type of the cloth holding frame 10 will be explained. The connecting part 16*a* of the cloth holding frame 10 has at least one of a first recess 16*e*, a second recess 16*f* and a third recess 16*g* of approximately triangular shapes. For instance, in the cloth holding frame 10 shown in FIG. 6, there are formed the first recess 16*e* and the third recess 16*g* of the three of the first to third recesses 16*e* to 16*g*.

When the cloth holding frame 10 is set in the Y carriage 13, the Y carriage 13 into which the connecting part 16*a* is fit has three of a first through a third detection switches 73 to 75 (see FIG. 12), which are brought into contact with the first through the third recesses 16*e* to 16*g* respectively. The first detection switch 73 outputs a detection signal of level "H" when it is in contact with the first recess 16*e*, or a detection signal of level "L" when it is not in contact with the first recess 16*e*.

As in the case of the first detection switch 73, the second and the third detection switches 74, 75 output the detection signals of level "H" when they are in contact with the second and third recesses 16*f*, 16*g* respectively, whereas they output the detection signals of level "L" when they are not in contact with the second and third recesses 16*f*, 16*g*. When the cloth holding frame 10 shown in FIG. 6 is set in the Y carriage 13, the first and the third detection switches 73, 75 output the detection signals of level "H", but the second detection switch 74 outputs the detection signal of level "L", since the cloth holding frame 10 has two recesses of the first and the third recesses 16*e*, 16*g*.

Next, a block diaphragm of a control system of the printer 1 will be explained with reference to FIG. 12.

The printer main body 11 comprises the control unit 80 including a CPU 81, a ROM 82, a RAM 83 and an input/output interface (I/O) 84, various operation switches 85 such as a print starting switch and a frame moving switch, a head-reference-height position detecting device 86 for setting a height of the print head 36 at a reference height (2 mm) with respect to a face to be printed of the cloth W, a drive circuit 87 for driving the print head 36, a drive circuit 88 for driving the head up-and-down driving motor 41, a drive circuit 89 for driving the back-and-forth driving motor 60, the drive circuit 91 for driving the purge motor 90, and a drive circuit 93 for driving the suction pump 92.

Further, the control unit 80 is electrically connected with the first through the third detection switches 73 to 75. The ROM 82 stores a control program for controlling and driving the driving mechanisms 12, 20, 50, 51, 55 and 56. In addition to the control program, the Rom 82 further stores a cloth holding frame type table data shown in FIG. 13 and a frame information table data shown in FIG. 14.

The cloth holding frame type table stores the data of the detection signals from the first through the third detection switches 73 to 75, in association with the types of the cloth holding frame 10. For instance, when the cloth holding frame 10 shown in FIG. 6 is set in the Y carriage 13, the first and the third detection switches 73, 75 output the detection signals of level "H", so that the type of the cloth holding frame 10 is detected as the "cloth holding frame F".

The cloth holding frame type table includes the data of printable areas, origin points O in the printable areas, and distances in the Y direction from the front-side two nozzle lines 36*c*, 36*d* to the ink tray 68, each of which are in association with the types of the cloth holding frame 10. As shown in FIG. 6, the distance in the Y direction is the distance from the origin point O (corresponding to a specific position) to the ink tray 68 in the Y direction with added the distance from the origin point O to the front-side two nozzle lines 36*c*, 36*d* in the Y direction.

For instance, when the cloth holding frame (F) 10 shown in FIG. 6 is set in the Y carriage 13, the printable area is "f1 to F 4", the origin point is "Of", and the distance to a flushing position FP of the ink tray 68 in the Y direction is "Yf". The distance "Yf" is the distance Yx in the Y direction from the origin point Of to the ink tray 68, added with the distance Ym in the Y direction from the origin point O to the front-side two nozzle lines 36*c*, 36*d*.

The frame driving mechanism 12 comprises a carriage position detection sensor 94 for detecting the position of the cloth holding frame 10 in the X and Y directions, a drive circuit 96 for driving the X direction driving motor 95 and the drive circuit 98 for driving the Y direction driving motor 97.

Figure 15:
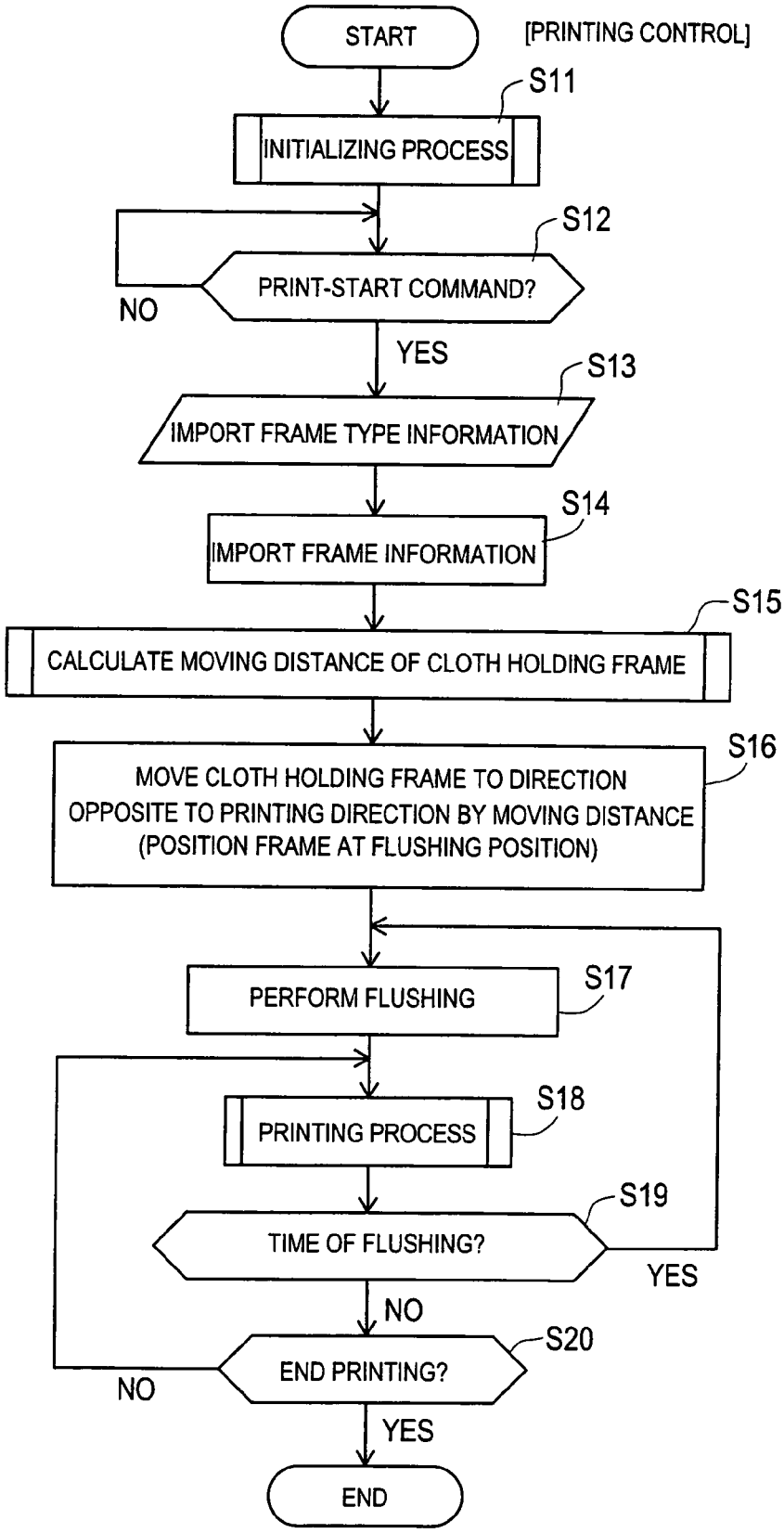
FIG. 15 is a flowchart of a printing control.

Next, a printing control performed in the control unit 80 in the printer main body 11 will be explained with reference to a flowchart of FIG. 15.

When the power is turned on, initializing operation is firstly performed in the printer 1 (S11). In this initializing operation, the initialization of the control system is performed. At the same time, the cloth holding frame 10 is moved with the frame driving mechanism 12, and the print head 36 is set at the position above the origin point (the center point) in the printable area.

When the cloth holding frame 10 holding the cloth W receives the print command when the cloth holding frame 10 is set in the Y carriage 13 (S12:Yes), the frame type information of the cloth holding frame 10 is imported from the cloth holding frame type table shown in FIG. 13, based on the detection signals from the first through the third detection switches (S13). Next, according to the frame type information, the frame information is read from the frame information table shown in FIG. 14 (S14).

Figure 16:
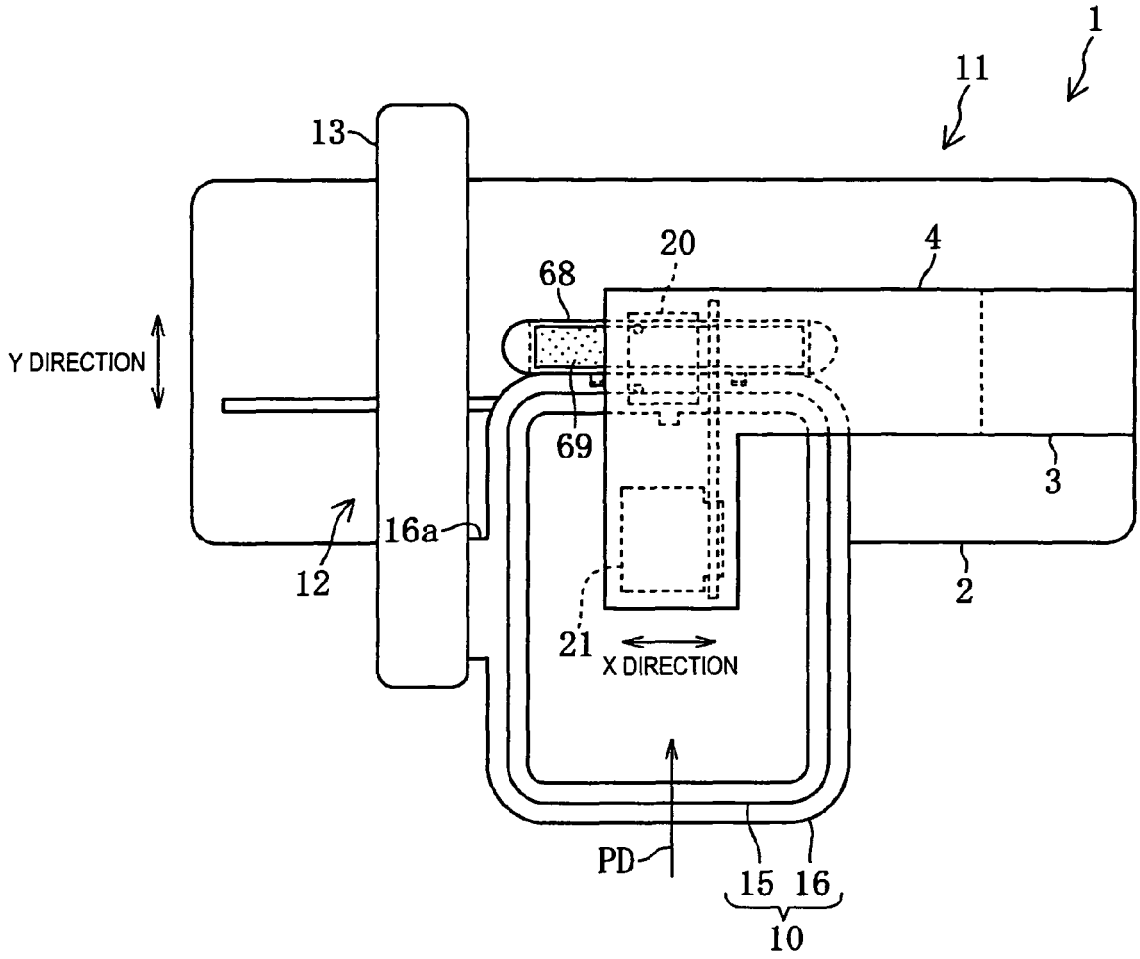
FIG. 16 is a plan view of the printer in a flushing, corresponding to FIG. 1.

Next, based on the frame information, the moving distance in the Y direction from the current position (the origin point) of the cloth holding frame 10 to the flushing position FP of the ink tray 68 is calculated for the flushing (S15). The cloth holding frame 10 is moved in the direction (frontward) opposite to the printing direction (PD), by the calculated moving distance (see FIG. 16) (S16).

The cloth holding frame 10 thereby positioned at the flushing point FP moves increasingly faster in the printing direction PD, and performs the flushing twice for the front side nozzle lines 36*c*, 36*d* and the rear side nozzle lines 36*a*, 36*d* continuously (S17). After that, the printing operation is performed in one line in the printable area, as mentioned above (S18).

In printing, the cloth holding frame 10 moves back and forth in the Y direction along the predetermined distance including the flushing position FP and the printable area. At the time of the flushing during the printing operation line by line (S19:Yes), the flushing is performed when the cloth holding frame 10 reaches the flushing position FP (S17). When the printing operation ends (S20:Yes), this control has been completed.

As mentioned above, the cloth holding frame 10 holding the cloth W to be printed is removably set in the frame driving mechanism 12 in the printer 1 in which the print head 36 is provided. The ink tray 68 is detachably provided in the cloth holding frame 10 to receive the jet of ink from the print head 36 by the flushing. Accordingly, the cloth holding frame 10 is moved to the position in which the print head 36 faces the ink tray 68 provided in the cloth holding frame 10, and then the flushing is performed. Therefore, the jet of ink from the print head 36 by the flushing is surely received by the ink tray 68 without being missed.

Furthermore, the ink tray 68 is provided in the cloth holding frame 10, so that the flushing can be performed as a part of the printing process while the cloth holding frame 10 is continuously moved, without the vertical movement of the print head 36. Accordingly, the maintenance time for the flushing becomes shorter, and the speed of the printing process is enhanced. Further, the controlling operation of the frame driving mechanism 12 to perform the flushing becomes simplified, and the printer 1 can be downsized.

Especially in the case where the ink tray 68 is detachably provided in the cloth holding frame 10, the ink tray 68 can be removed from the cloth holding frame 10 while the cloth W is set in or removed. This can avoid the ink tray 68 from being the obstacle while the setting/removing operation. Also, this can avoid the cloth W and fingers of the operator form getting dirty while the setting/removing operation.

The cloth holding frame 10 has the outer frame 16 and the inner frame 15. The ink tray 68 is provided outside the rim of the outer frame 16, so that the printable area inside the inner frame 15 can be kept as large as it is. Further, the cloth W is set on the top face of the cloth holding frame 10. Accordingly, the ink tray 68 can be positioned at the predetermined flushing position facing to the print head 36 only by the horizontal movement of the cloth holding frame 10, without the vertical movement of the print head 36.

The ink tray 68 provided outside the rim of the outer frame 16 can surely receive the ink directed in the jet from the print head 36.

When the cloth holding frame 10 is set in the printer 1, the ink tray 68 is of the rectangular shape having the long side parallel with the nozzle lines 36*a* to 36*d*, and is longer than the nozzle lines 36*a* to 36*d*. Therefore, the width of the ink tray 68 can be as wide as the two rows of the nozzle lines formed in the print head 36, and the ink tray 68 can be downsized.

Furthermore, the ink tray 68 is longer than the nozzle lines 36*a* to 36*d*, so that all of the nozzles can be flushed at the same time. The time for the flushing can become shorter.

When the cloth holding frame 10 is set in the printer 1, the ink tray 68 is provided in a short side 16*b* of the outer frame 16, or the rear outside (the rim side) of the outer frame 16 opposite to an operator side (front side). Therefore, the ink tray 68 can be avoided from being the obstacle while the operator is setting the cloth holding frame 10 in the frame driving mechanism 12, and uses the printer 1.

The replaceable ink absorber 69 is installed inside the ink tray 68, so that the ink received by the ink tray 68 is never spilled out while the cloth holding frame 10 is moving, and only the ink absorber can be easily replaced as needed.

Furthermore, the printer 1 comprises the print head 36, the cloth holding frame 10 holding the cloth W, and the frame driving mechanism 12 for moving the cloth holding frame 10 in each of the X and Y directions intersecting at right angles with respect to the print head 36, and performs printing on the cloth W, moving the cloth holding frame 10 by the frame driving mechanism 12 with respect to the cloth W. In this printer 1, the position of the ink tray 68 with respect to the cloth W can be detected in an association with a target position of the cloth holding frame 10. Based on the movement of the frame driving mechanism 12 and the detected position of the ink tray 68, the ink tray 68 can be positioned at the predetermined flushing position FP facing to the print head 36 in the flushing. Therefore, the ink tray 68 provided in a part of the cloth holding frame 10 can be positioned securely and easily at the predetermined flushing position FP facing to the print head 36, since the position of the ink tray is detected in the association with the target position of the cloth holding frame 10 set in the frame driving mechanism 12.

The frame information includes the types of the cloth holding frame 10*m* and, in association therewith, the flushing position FP of the ink tray 68 with respect to the origin point of the cloth holding frame 10, for the detection of the type of the cloth holding frame 10 set in the frame driving mechanism 12. Based on the type of the cloth holding frame 10 and the frame information, the frame driving mechanism is moved to position the ink tray 68 at the predetermined flushing position FP. With just the movement of the frame driving mechanism based on the type of the cloth holding frame 10 set in the frame driving mechanism 12, the flushing can be performed. Therefore, the detecting control of the ink tray 68 position can be simplified.

Furthermore, the first through the third recesses 16*e* to 16*g* provided in the connecting part 16*a* of the cloth holding frame 10 are detected by the first through the third detection switches 73 to 75 provided in the Y carriage 13 of the frame driving mechanism 12 respectively. With only the detection of the first through the third recesses 16*e* to 16*g* which are unique to each type of the cloth holding frame 10 set in the connecting part 16*a* of the cloth holding frame 19, the type of the cloth holding frame 10 can be reliably identified based on the first through the third recesses 16*e* to 16*g*. Accordingly, the frame information of each cloth holding frame 19 can be correctly read.

Next, some modified aspects of partial modifications of the above aspect will be explained.

Firstly, a first of some modified aspects will be explained with reference to FIGS. 17 to 19. A detector provided in a printer 1 determines the flushing position FP with respect to an ink tray 68A, by detecting a seal 101 provided in the ink tray 68A just after the power-on.

Figure 17:
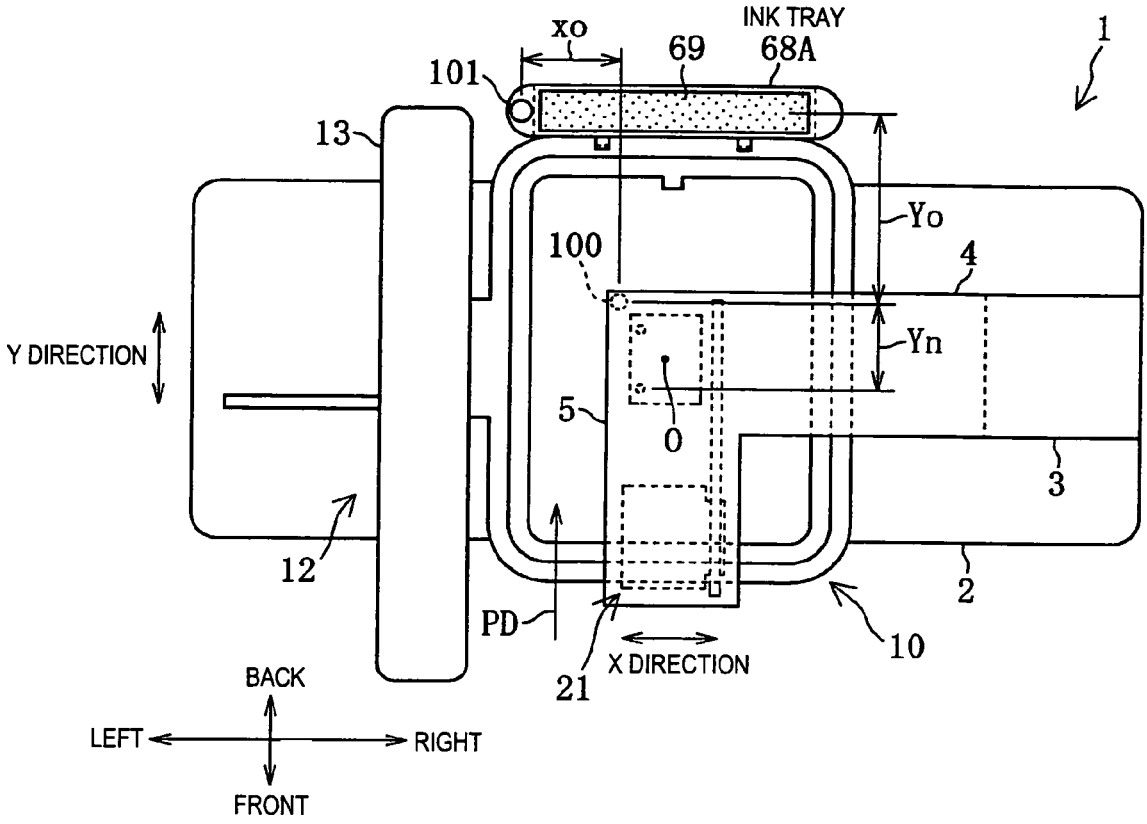
FIG. 17 is a plan view of the printer in a first modified aspect, corresponding to FIG. 1.

As shown in FIG. 17, a photo interrupter 100 (corresponding to the detector) is fixed to the underside of the corner of the arm 4 and the mechanism attachment 5, facing downward. The detection seal 101 which is small, round and reflectable is adhered to the top face of the left end of the ink tray 68A. The photo interrupter 100 integrally comprises a light emitter and a photoreceptor. The light emitted from the light emitter directly downward can be received by the photoreceptor when the light is reflected by the detection seal 101.

When the print head 36 faces to the origin point of the cloth holding frame 10 (see FIG. 17), "X0", or the distance in the X direction from the photo interrupter 100 to the detection seal 101, is set as long as all other types of the cloth holding frame 10 of the various sizes and shapes. On the other hand, the distance "Y0" in the Y direction from the photo interrupter 100 to the detection seal 101 depends on the type of the cloth holding frame 10. However, the distance "Yn" in the Y direction from the nozzle lines 36*c*, 36*d* on the front side is the predetermined distance.

Figure 18:
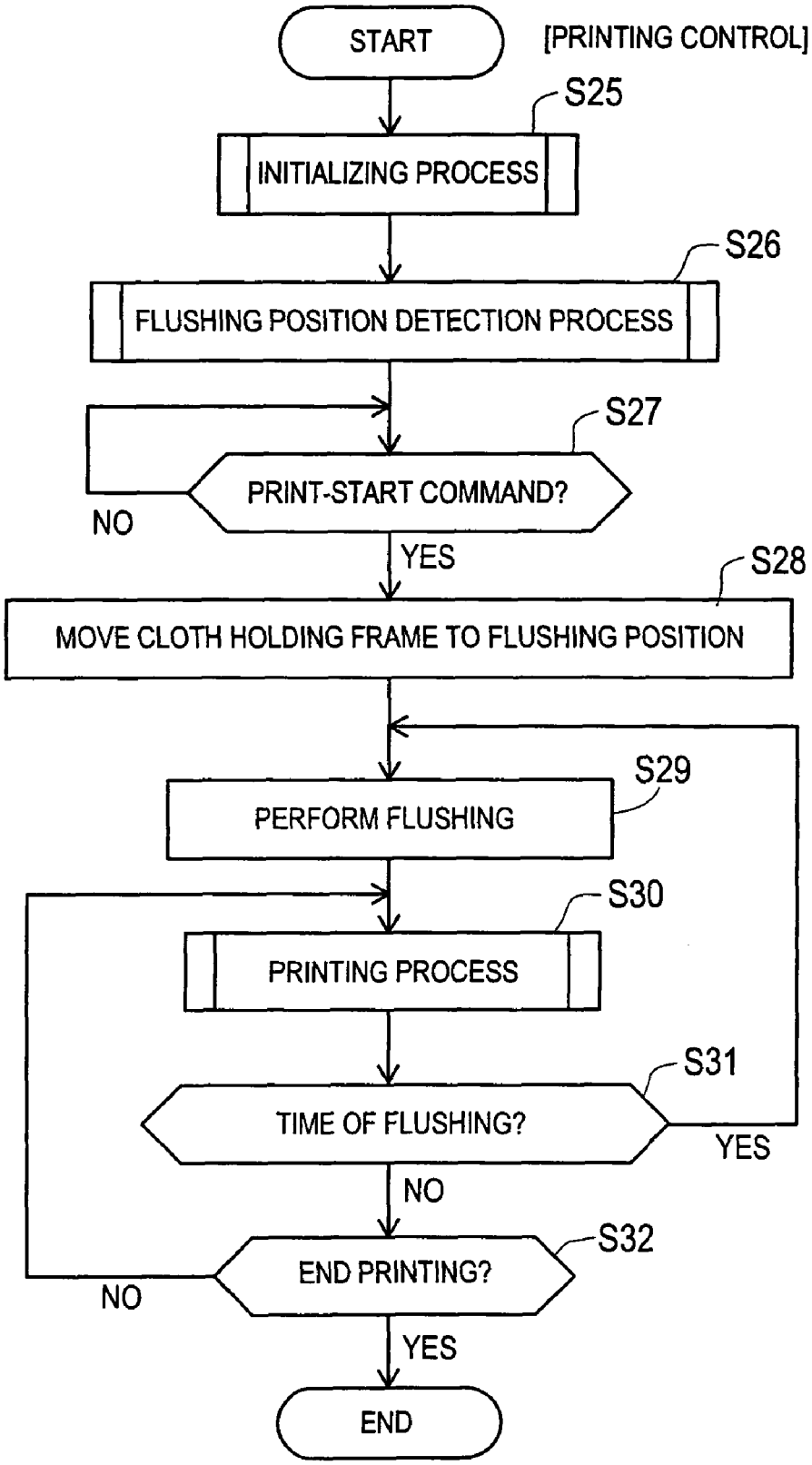
FIG. 18 is a flowchart of printing control.
Figure 19:
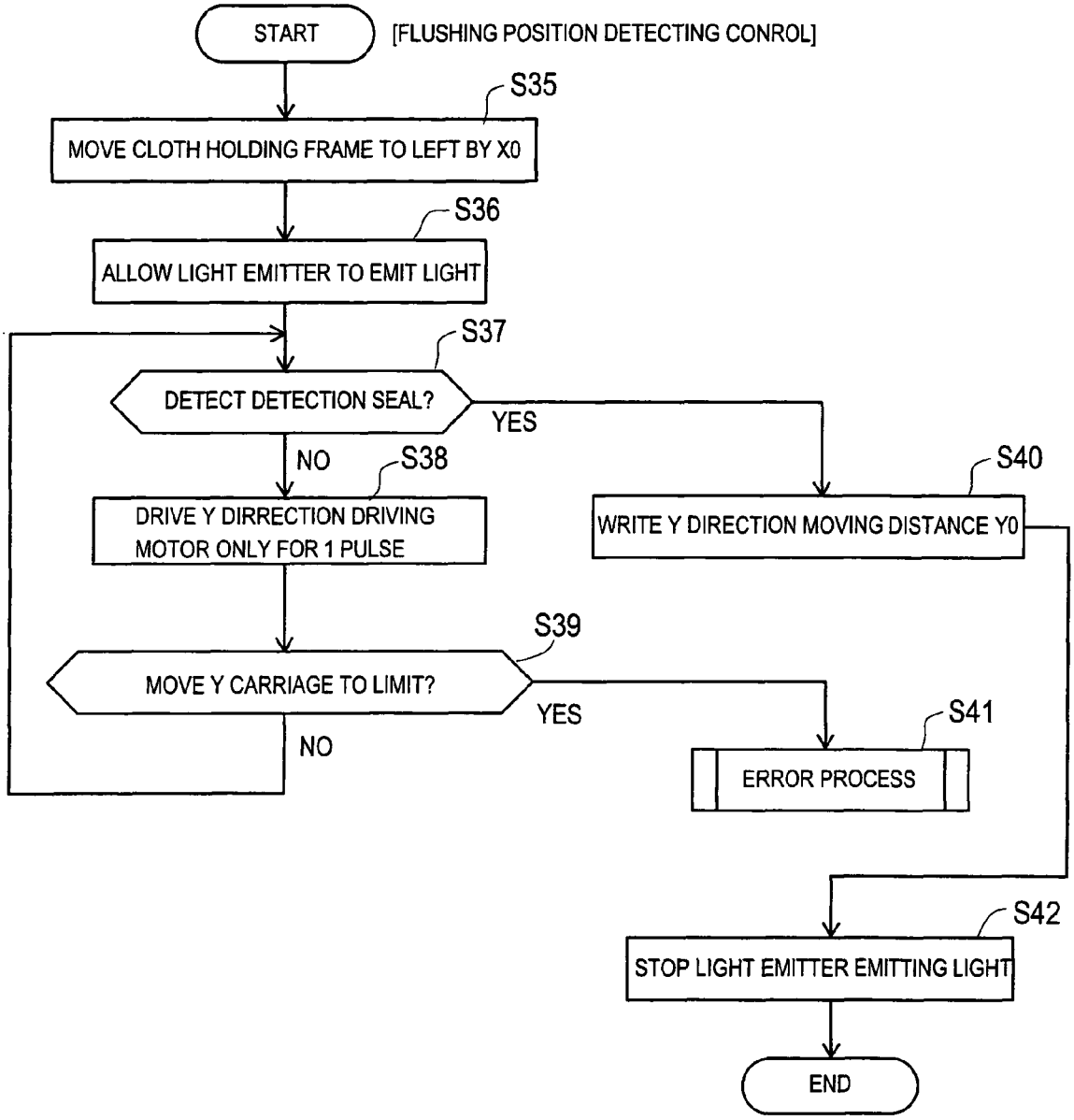
FIG. 19 is a flowchart of flushing position detecting control.

The printing control starts, and the initializing process is performed in a same manner as S11 of the printing control in the abovementioned aspect (S25), as shown in FIG. 18. A flushing position detection process is performed (S19). The control starts, and then the cloth holding frame 10 is moved in the X direction by the distance "X0" (S35), as shown in FIG. 19. Next, the light emitter of the photo interrupter 100 emits the light (S36). When the detection seal 101 is not detected, or the photoreceptor does not receive the reflected light (S37: No), the Y direction driving motor 97 is driven only for 1 pulse (S38).

When the Y carriage 13 is not at the limit position of moving in the Y direction (S39:No), the process repeats from S37 to S39. The detection seal 101 is detected with the result that the light emitted from the light emitter is reflected by the detection seal 101, and the photoreceptor receives the reflected light (S37:Yes), the moving distance "Y0" in the Y direction is written (S40). The light emitter is stopped emitting the light (S42), and this control ends. The process returns to the printing control.

When the Y carriage 13 is at the limit position of moving in the Y direction (S39:Yes), the error process is performed, giving an warning sound for instance (S41). In the printing control, the print-start command is executed when the cloth holding frame 10 holding the cloth W is set in the Y carriage 13 (S27:Yes), and the cloth holding frame 10 is moved from the current position (the origin point) to the flushing position (FP) for the flushing (S28).

As mentioned above, the cloth holding frame 10 is at first moved in the X direction by the distance "X0". After that, the detection seal 101 is detected while the cloth holding frame 10 is moved in the Y direction. Finally, the cloth holding frame 10 reaches the flushing position FP.

The cloth holding frame 10 thereby positioned at the flushing position FP moves increasingly faster in the printing direction PD, and performs the flushing twice for the front side nozzle lines 36*c*, 36*d* and the rear side nozzle lines 36*a*, 36*d* continuously (S29). After that, the printing operation is performed in one line in the printable area, as mentioned above (S30).

In printing, the cloth holding frame 10 moves back and forth in the Y direction along the predetermined distance including the flushing position FP and the printable area. At the time of the flushing during the printing operation line by line (S31:Yes), the flushing is performed when the cloth holding frame 10 reaches the flushing position FP (S29). When the printing operation ends (S320:Yes), this control has been completed.

As described above, the detection seal 101 as a to-be-detected portion is provided in a part of the ink tray 68A. The ink tray 68A is positioned at the predetermined flushing position FP with the detection of the detection seal 101 with the photo interrupter 100 provided in the print head 36 while the frame driving mechanism 12 is moving. Accordingly, the flushing can be performed only by the detection of the detection seal 101 by the photo interrupter 100 while the frame driving mechanism 12 is moving. This can simplify the position detecting control of the ink tray 68A.

Figure 20:
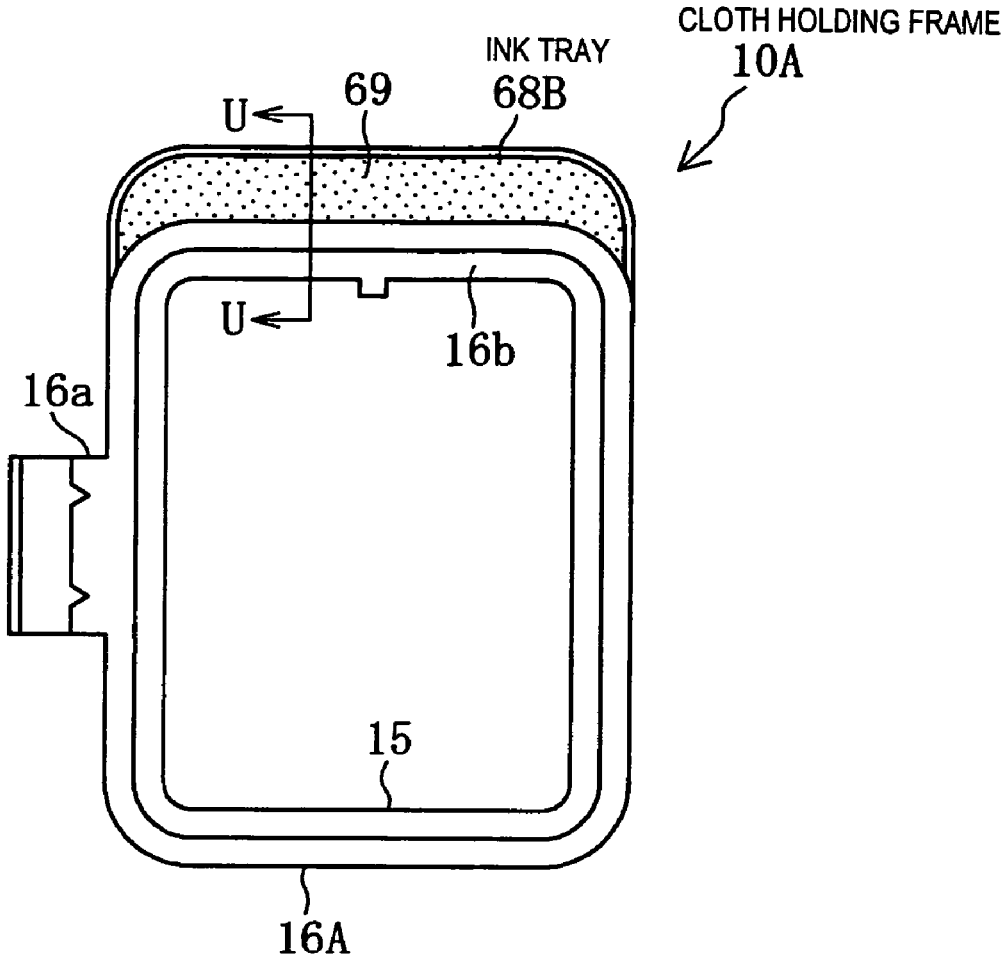
FIG. 20 is a plan view of the cloth holding frame in a second modified aspect, corresponding to FIG. 6.
Figure 21:
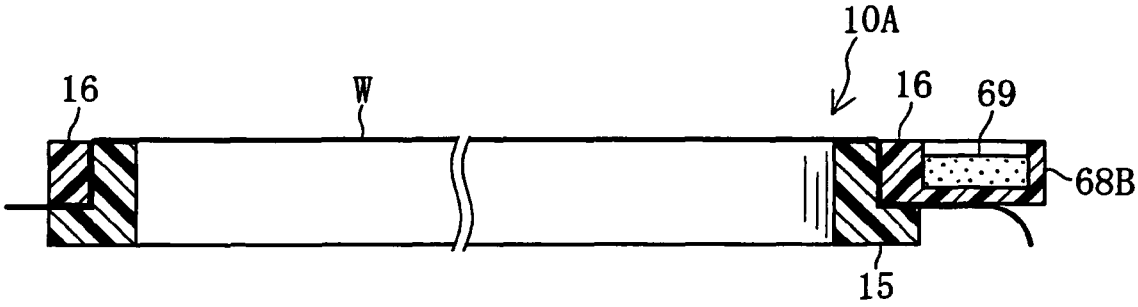
FIG. 21 is a longitudinal cross sectional view of FIG. 20 in a line C-C.

Next, a second of some modified aspects will be explained with reference to FIGS. 20 and 21. As shown in FIGS. 20 and 21, the ink tray 68B may be integrally formed in the short side 16*b* of the outer frame 16A of the cloth holding frame 10A. In this case, the structure of the ink tray 68A can be simplified. Further, the ink tray 68B can be avoided being lost.

Figure 22:
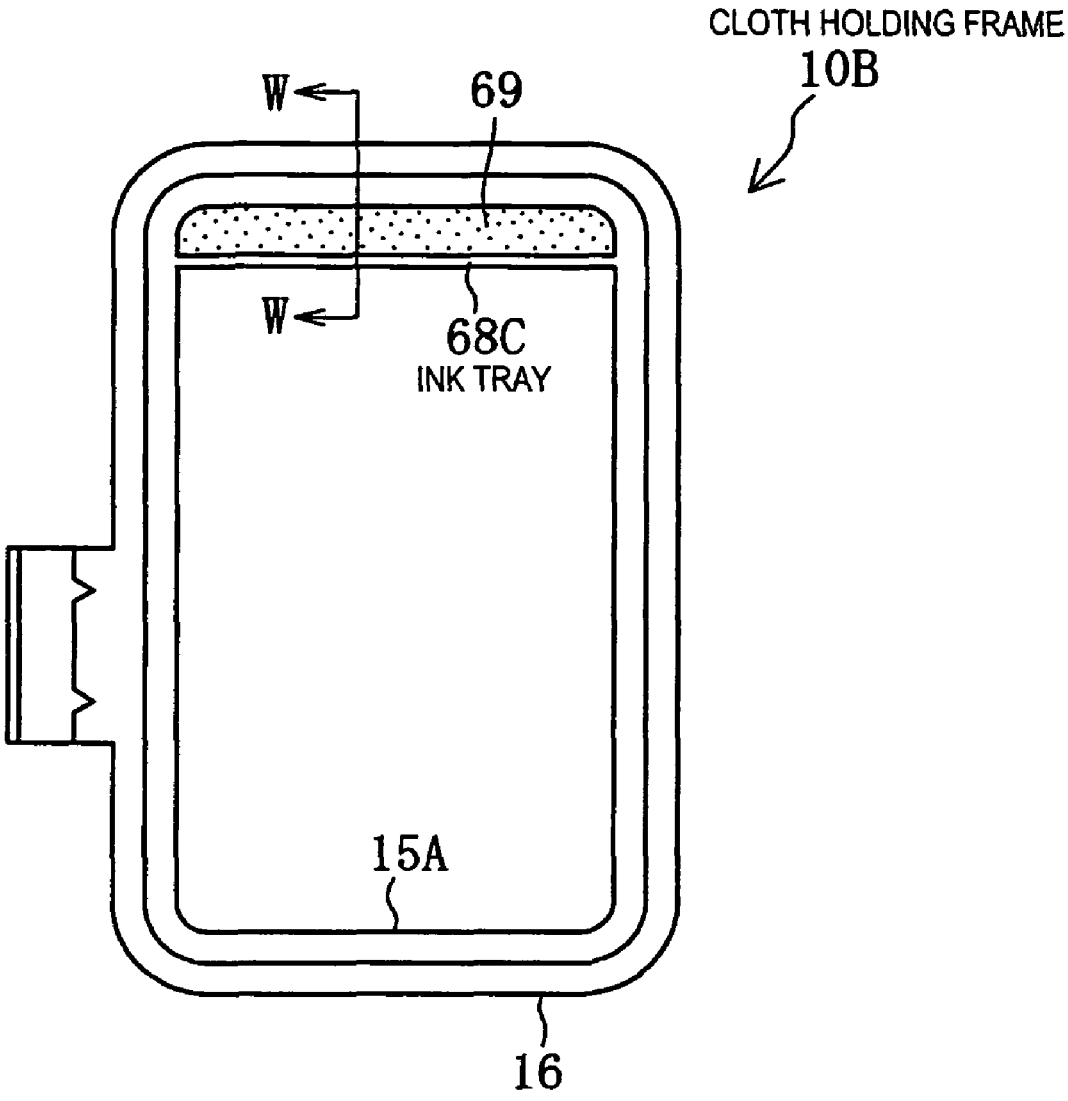
FIG. 22 is a plan view of the cloth holding frame in a third modified aspect, corresponding to FIG. 6.
Figure 23:
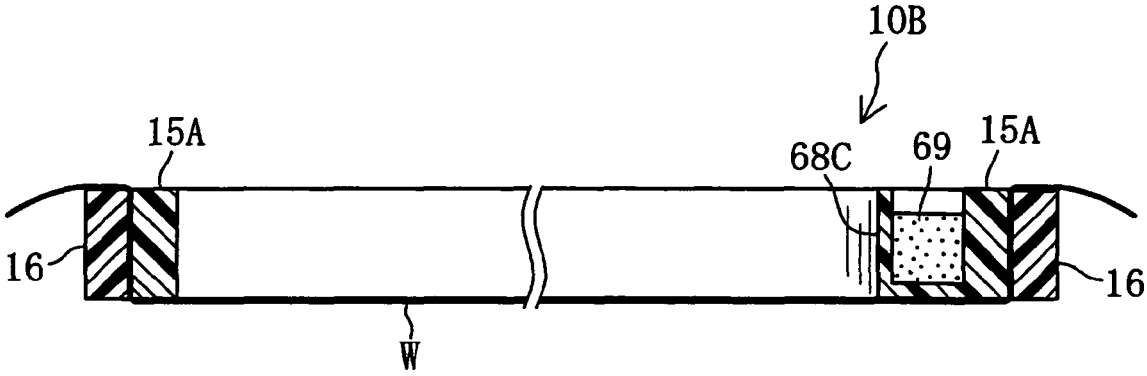
FIG. 23 is a longitudinal cross sectional view of FIG. 21 in a line W-W.

Next, a third of some modified aspects will be explained with reference to FIGS. 22 and 23. As shown in FIGS. 22 and 23, the ink tray 68C may be integrally formed inside the inner frame 15A of the cloth holding frame 10B. Also in this case, the structure of the ink tray 68C can be simplified. Further, the ink tray 68C can be avoided being lost.

Furthermore, the ink tray 68C formed inside the inner frame 15A of the cloth holding frame 10B can surely receive the ink directed in the jet from the print head 36 by the flushing. Furthermore, the ink tray 68C may be detachably provided, not being integrally formed in the inner frame 15A.

While the presently aspect has been shown and described, it is to be understood that this disclosure is for the purpose of illustration and that various changes and modifications may be made without departing from the scope of the disclosure as set forth in the appended claims.

What is claimed is:

1. A printer comprising:

a cloth holding frame comprising one of an integrally-formed ink tray and a detachable ink tray that moves together with the cloth holding frame relative to an inkjet head, for receiving an ink discharged from the inkjet head in flushing for the inkjet head;

a frame driving mechanism for moving the cloth holding frame in a back and forth direction and a side to side direction intersecting at right angles with respect to the inkjet head, and for performing printing on a cloth while moving the cloth holding frame with respect to the inkjet head;

a detection device for detecting a position of the ink tray in an association with a target position of the cloth holding frame; and a flushing control device for positioning the ink tray at a predetermined flushing position facing to the inkjet head based on the movement of the frame driving mechanism and a detection result of the detection device, wherein the detection device comprises:

a frame information storage device for storage frame information including the type of the cloth holding frame and, in association therewith, the position of the ink tray with respect to a specified point of the cloth holding frame, and a frame type detection device for detecting the type of the cloth holding frame set in the frame driving mechanism, and the flushing control device positions the ink tray at the predetermined flushing position facing to the inkjet head by moving the frame driving mechanism based on the type of the cloth holding frame detected by the frame type detection device and the frame information of the frame information storage device.

2. The printer according to claim 1, further comprising an outer frame and an inner frame, wherein the ink tray is provided outside a rim of the outer frame.

3. The printer according to claim 1, further comprising an outer frame and an inner frame, wherein the ink tray is provided inside the inner frame.

4. The printer according to claim 1, wherein the ink tray is of a rectangular shape having a long side parallel with a nozzle line, and the ink tray is longer than the nozzle line, when the cloth holding frame is set in the frame driving mechanism.

5. The printer according to claim 4, wherein the ink tray is provided on a side opposite to an operator side on which an operator works, when the cloth holding frame is set in the frame driving mechanism.

6. The printer according to claim 1, wherein a replaceable ink absorber is provided inside the ink tray.

7. A printer comprising:

a cloth holding frame comprising one of an integrally-formed ink tray and a detachable ink tray that moves together with the cloth holding frame relative to an inkjet head, for receiving an ink discharged from the inkjet head in flushing for the inkjet head;

a frame driving mechanism for moving the cloth holding frame in a back and forth direction and a side to side direction intersecting at right angles with respect to the inkjet head, and for performing printing on a cloth while moving the cloth holding frame with respect to the inkjet head;

a detection device for detecting a position of the ink tray in an association with a target position of the cloth holding frame;

a flushing control device for positioning the ink tray at a predetermined flushing position facing to the inkjet head based on the movement of the frame driving mechanism and a detection result of the detection device;

a connecting part formed in the cloth holding frame, for setting the cloth holding frame on the frame driving mechanism by a connection with the frame driving mechanism; and a to-be-connected part provided on the frame driving mechanism, for being connected to the connecting part, wherein the detection device comprises:

a frame information storage device for storing frame information including the type of the cloth holding frame and, in association therewith, the position of the ink tray with respect to a specified point of the cloth holding frame, and a frame type detection device for detecting the type of the cloth holding frame set in the frame driving mechanism, the flushing control device positions the ink tray at the predetermined flushing position facing to the inkjet head by moving the frame driving mechanism based on the type of the cloth holding frame detected by the frame type detection device and the frame information of the frame information storage device, and the frame type detection device comprises:

a to-be-detected element provided the connecting part, of which pattern depends on the type of the cloth holding frame, and a to-be-detected element detection device provided in the to-be-connected part, for detecting the patter of the to-be-detected element.

8. The printer according to claim 7, further comprising an outer frame and an inner frame, wherein the ink tray is provided outside a rim of the outer frame.

9. The printer according to claim 7, further comprising an outer frame and an inner frame, wherein the ink tray is provided inside the inner frame.

10. The printer according to claim 7, wherein the ink tray is of a rectangular shape having a long side parallel with a nozzle line, and the ink tray is longer than the nozzle line, when the cloth holding frame is set in the frame driving mechanism.

11. The printer according to claim 10, wherein the ink tray is provided on a side opposite to an operator side on which an operator works, when the cloth holding frame is set in the frame driving mechanism.

12. The printer according to claim 7, wherein a replaceable ink absorber is provided inside the ink tray.

* * * * *